US005807080A

United States Patent [19]

Ochiai et al.

[11] Patent Number: 5,807,080

[45] Date of Patent: Sep. 15, 1998

[54] VARIABLE DISPLACEMENT TYPE PISTON MACHINE OF WHICH NOISE AND VIBRATION ARE REDUCED BY REDUCING PULSATION OF DISCHARGE FLUID

[75] Inventors: Takashi Ochiai; Yasuyuki Murakami, both of Osaka, Japan

[73] Assignee: Daikin Industries, Ltd., Osaka, Japan

[21] Appl. No.: 722,132

[22] PCT Filed: Feb. 6, 1996

[86] PCT No.: PCT/JP96/00238

§ 371 Date: Nov. 4, 1996

§ 102(e) Date: Nov. 4, 1996

[87] PCT Pub. No.: WO96/24765

PCT Pub. Date: Aug. 15, 1996

[30] Foreign Application Priority Data

Feb. 10, 1995 [JP] Japan ..... 7-022608
Oct. 4, 1995 [JP] Japan ..... 7-257456

[51] Int. Cl.[6] ..... F04B 1/12

[52] U.S. Cl. ..... 417/269; 92/71

[58] Field of Search ..... 417/269; 92/71

[56] References Cited

U.S. PATENT DOCUMENTS 5,538,401 7/1996 Schaffner et al. ..... 417/222.1
5,573,380 11/1996 Martensen et al. ..... 417/269
5,593,285 1/1997 Watts ..... 417/269
5,683,228 11/1997 Beatty ..... 417/269

FOREIGN PATENT DOCUMENTS 56-6080 1/1981 Japan .
54-176102 6/1983 Japan .
59-7786 1/1984 Japan .
4-95671 8/1992 Japan .

*Primary Examiner*—Timothy Thorpe
*Assistant Examiner*—Ehud Gartenberg
*Attorney, Agent, or Firm*—Birch, Stewart, Kolasch & Birch, LLP

[57] ABSTRACT

There is provided a variable displacement type piston machine capable of reducing noise and vibration through reduction of pulsation of discharge fluid by reducing the variation of the rate of operating fluid that is flowing from a high pressure port to a low pressure port and a drain. On a slide surface (1*a*) of a valve plate (1) is provided an intermittent drain passage (5) in a manner that it directly communicates with neither a high pressure port (3*a*) nor an oil guide groove (4). When the high pressure port (3*a*) and a cylinder port (54*a*) are communicated with each other via the oil guide groove (4) and a back flow from the high pressure port (3*a*) to the cylinder port (54*a*) is generated, the intermittent drain passage (5) communicates with neither the high pressure port (3*a*) nor the cylinder port (54*a*). When a cylinder block (55) further rotates from the above state, the intermittent drain passage (5) communicates with the high pressure port (3*a*) via the cylinder port (54*a*).

13 Claims, 12 Drawing Sheets

0 deg (40deg)

5 deg 10 deg 35 deg 30 deg 71
77
B
75
75a
75b
74
2a
71b
2b
2c
3a
3b
3c 71
71a
71b
74
76

71
71a
B
4
75
75a
2a
2b
2c
3a
3b
3c
76

VARIABLE DISPLACEMENT TYPE PISTON MACHINE OF WHICH NOISE AND VIBRATION ARE REDUCED BY REDUCING PULSATION OF DISCHARGE FLUID

TECHNICAL FIELD

The present invention relates to a variable displacement type piston machine such as a variable displacement type piston pump or a variable displacement type piston motor.

BACKGROUND ART

Conventionally, there has been a variable displacement type piston pump as shown in FIG. 15 (Japanese Utility Model Laid-Open Publication No. SHO 54-176102). This variable displacement type piston pump comprises a valve plate 53 provided with a suction port 51 which serves as a low pressure port and a discharge port 52 which serves as a high pressure port; a cylinder block 55 which rotates while sliding on a slide surface of the valve plate 53 and includes a plurality of cylinders 54, 54, . . . in its axial direction; and a plurality of pistons 57, 57, . . . which reciprocate inside the cylinders 54, 54, . . . by a swash plate 56 according as the cylinder block 55 rotates. As shown in FIG. 16, an oil guide groove 59 which extends from the discharge port 52 to the proximity of a bottom dead center as indicated by B in the figure is provided on a slide surface 58 between the suction port 51 and the discharge port 52 of the valve plate 53. This oil guide groove 59 is comprised of a cut portion 59*a* and a V-notch 59*b* as shown in FIGS. 16 and 17.

When a cylinder port 54*a* is moved from the suction port 51 to the discharge port 52 by the rotation of the cylinder block 55, a gradual back flow is generated from the discharge port 52 to the cylinders 54 by the oil guide groove 59 so that a gradual pressure variation is caused inside the cylinders 54 and the discharge port 52, by which the pressure variation inside the cylinders 54 and the discharge port 52 when the cylinder port 54*a* is moved from the suction port 51 to the discharge port 52 is eased to reduce the noise and vibration from the variable displacement type piston pump and its piping.

However, in the above prior art variable displacement type piston pump, a fluid flow from the discharge port 52 to the cylinders 54 takes place intermittently every time the cylinder port 54*a* communicates with the oil guide groove 59 according as the cylinder block 55 rotates, and this has caused the problem that the pulsation is still great and the noise and vibration are great, also impairing the operation characteristic of the whole fluid apparatus.

Accordingly, it is an object of the present invention to provide a variable displacement type piston machine having an oil guide groove that allows a high pressure port and a cylinder to intermittently communicate with each other, wherein its operating fluid is guided from the high pressure port to a drain when no back flow takes place in the oil guide groove to reduce the variation in amount of the operating fluid that is flowing from the high pressure port to a low pressure port, so that the pulsation of discharge fluid is reduced to allow the noise and vibration to be reduced and allow the operation characteristic of the whole apparatus to be improved.

DISCLOSURE OF THE INVENTION

In order to achieve the aforementioned object, the present invention provides a variable displacement type piston machine provided with: a valve plate having a slide surface at which a low pressure port and a high pressure port are opened; a cylinder block, in which pistons respectively reciprocate in a plurality of axially provided cylinders and cylinder ports respectively communicated with the cylinders are opened on a slide surface of the cylinder block that slides on the slide surface of the valve plate, and which rotates to the valve plate; and an oil guide groove which is provided between the low pressure port and the high pressure port on the slide surface of the valve plate and extends from the high pressure port toward a dead center, said high pressure port and said cylinder port being communicated with each other via the oil guide groove to cause a gradual pressure variation inside the cylinders and the high pressure port, the variable displacement type piston machine comprising an intermittent drain passage which is opened on the slide surface of the valve plate and directly communicates with neither the high pressure port nor the oil guide groove, wherein in an initial stage in which the high pressure port and the cylinder port are communicated with each other via the oil guide groove, the intermittent drain passage communicates with none of the high pressure port, the oil guide groove and the cylinder port, and when the cylinder block is further rotated, the intermittent drain passage communicates with the high pressure port via the cylinder port.

In the variable displacement type piston machine of the present invention, it is assumed that this variable displacement type piston machine is a variable displacement type piston pump. In this case, the oil guide groove is provided on the slide surface so that it extends from the high pressure port toward a bottom dead center. When the cylinder port moves from the low pressure port to a high pressure port according as the cylinder block rotates while being in contact with the slide surface of the valve plate, the cylinder port firstly communicates with the oil guide groove in the vicinity of the bottom dead center before communicating with the high pressure port. Therefore, the operating fluid gradually flows back from the high pressure port to the cylinder through the oil guide groove. Therefore, the possible occurrence of an abrupt pressure variation inside the cylinder and the high pressure port when the cylinder moves from the low pressure port to the high pressure port is prevented.

In this stage, the intermittent drain passage is not communicated with the cylinder port, and therefore, it is communicated with neither the high pressure port nor the oil guide groove. Therefore, in this stage, the operating fluid is substantially not flowing through the intermittent drain passage.

When the cylinder block further rotates from the above state, the pressure inside the cylinder is increased, so that the back flow of the operating fluid passing through the oil guide groove from the high pressure port to the cylinder port disappears. However, in this stage, the intermittent drain passage communicates with the cylinder port and then communicates with the high pressure port via the cylinder port. Therefore, a flow of operating fluid is generated from the high pressure port through the intermittent drain passage to a casing drain or a tank.

Thus, the intermittent drain passage is closed when a back flow is taking place in the oil guide groove, while the intermittent drain passage is opened when the back flow disappears in the oil guide groove to thereby discharge the operating fluid from the high pressure port to the drain. Consequently, the pressure variation in the high pressure port is reduced. Therefore, the pulsation is reduced to allow the noise and vibration to be reduced, so that the operation characteristic of the whole machine can be improved.

Furthermore, the intermittent drain passage intermittently communicates with the cylinder port, meaning it does not always form a drain flow. Therefore, an increased volume efficiency is achieved in comparison with the case where a passage for always forming a drain flow is provided.

When the variable displacement type piston machine is a variable displacement type piston motor, the oil guide groove is provided on the slide surface so that it extends from the high pressure port to a top dead center, and the intermittent drain passage is provided in the vicinity of the high pressure port and the oil guide groove. Its operation is similar to that of the variable displacement type piston pump.

According to the variable displacement type piston machine of one embodiment, in the above variable displacement type piston machine, the intermittent drain passage comprises a first intermittent drain passage part and a second intermittent drain passage part. In a first state, the first intermittent drain passage part communicates with the cylinder port to communicate with the high pressure port via the cylinder port, while the second intermittent drain passage part is not communicated with the cylinder port. In a second state in which the cylinder block has rotated from the first state, both the first intermittent drain passage part and the second intermittent drain passage part communicate with the cylinder port to communicate with the high pressure port via the cylinder port. In a third state in which the cylinder block has rotated from the second state, the second intermittent drain passage part communicates with the cylinder port to communicate with the high pressure port via the cylinder port, while the first intermittent drain passage part is not communicated with the cylinder port.

In the variable displacement type piston machine of the above embodiment, in the first state in which the rate of the back flow flowing through the oil guide groove is small, the first intermittent drain passage part communicates with the high pressure port via the cylinder port, while the second intermittent drain passage part is not communicated with the cylinder port. Therefore, in this stage, a small amount of operating fluid is discharged from the high pressure port to the drain by way of only the first intermittent drain passage part. When the first state shifts to the second state in which no back flow takes place in the oil guide groove, both the first intermittent drain passage part and the second intermittent drain passage part communicate with the high pressure port via the cylinder port. Therefore, in this stage, a great amount of operating fluid is discharged from the high pressure port to the drain by way of both the first intermittent drain passage part and the second intermittent drain passage part. When the second state shifts to the third state in which the rate of the back flow flowing through the oil guide groove is small, the second intermittent drain passage part communicates with the high pressure port via the cylinder port, while the first intermittent drain passage part is not communicated with the cylinder port. Therefore, in this stage, a small amount of operating fluid is discharged from the high pressure port to the drain by way of only the second intermittent drain passage part.

Thus, the flow rate of drain is controlled in two steps by the first and second intermittent drain passage parts in accordance with the rate of back flow flowing through the oil guide groove, thereby allowing the sum of the rate of back flow and the flow rate of drain to be made approximately constant. Therefore, the pulsation inside the high pressure port can be further reduced.

According to the variable displacement type piston machine of one embodiment, the intermittent drain passage has one intermittent drain groove which is provided on the slide surface of the valve plate and intermittently communicates with the cylinder port according as the cylinder block rotates.

When the intermittent drain passage is thus constituted by the intermittent drain groove formed on the slide surface, the cylinder block slides on the slide surface of the valve plate, and the valve plate receives small impact and vibration from the cylinder block. Therefore, the intermittent drain groove scarcely clog with dirts and foreign matters, and if it is clogged, the dirt or the like is easily removed.

According to the variable displacement type piston machine of one embodiment, the first intermittent drain passage part and the second intermittent drain passage part are respectively a first intermittent drain groove and a second intermittent drain groove, which are provided on the slide surface of the valve plate.

When the first and second intermittent drain passage parts are constituted by the first and second intermittent drain grooves formed on the slide surface, the cylinder block slides on the slide surface of the valve plate, and the valve plate receives small impact and vibration from the cylinder block. Therefore, the first and second intermittent drain grooves scarcely clog with dirts and foreign matters, and if they are clogged, the dirt or the like is easily removed.

According to the variable displacement type piston machine of one embodiment, the intermittent drain passage is comprised of an intermittent drain groove provided on the slide surface of the valve plate and a through hole which is communicated with the intermittent drain groove and axially penetrates the valve plate to communicate with a drain.

According to the variable displacement type piston machine of the above embodiment, the cylinder block slides on the intermittent drain groove on the slide surface with a minute vibration. Therefore, the intermittent drain groove scarcely clogs with dirt or the like, and if it is clogged, the dirt or the like can be easily removed. Furthermore, the operating fluid is discharged to the drain through the through hole that axially penetrates the valve plate. Consequently, the direction in which the operating fluid flows is changed at a connection between the intermittent drain groove and the through hole, so that energy is consumed. Therefore, a reduced noise is achieved in discharging the operating fluid to the casing drain or the like.

According to the variable displacement type piston machine of one embodiment, the intermittent drain passage is comprised of only an intermittent drain groove which is provided on the slide surface of the valve plate and opened at a peripheral surface of the valve plate.

In this case, the intermittent drain passage is comprised of only the intermittent drain groove opened at the peripheral surface of the valve plate. Therefore, the intermittent drain groove scarcely clogs with dirt or the like, and the dirt or the like can be easily removed.

According to the variable displacement type piston machine of one embodiment, the intermittent drain passage is comprised of only a through hole which penetrates the valve plate.

In this case, the intermittent drain passage can be easily processed.

According to the variable displacement type piston machine of one embodiment, the intermittent drain passage has a plurality of intermittent drain grooves which successively communicate with the cylinder port according as the cylinder block rotates.

When the intermittent drain passage is comprised of a plurality of intermittent drain grooves, the amount of operating fluid discharged to the drain through the intermittent drain passage can be controlled in a number of steps according to the rate of back flow in the oil guide groove. Therefore, pulsation, vibration and noise can be further reduced.

According to the variable displacement type piston machine of one embodiment, the plurality of intermittent drain grooves are parallel to one another.

In this case, the intermittent drain grooves can be easily processed.

According to the variable displacement type piston machine of one embodiment, the intermittent drain passage is comprised of an intermittent drain through hole which axially penetrates the valve plate and is opened at the slide surface and a back surface of the valve plate, and a groove which is provided on the back surface of the valve plate and is communicated with the intermittent drain through hole and a drain.

In this case, the diameter of the intermittent drain through hole can be increased to allow the rate of intermittent drainage to be regulated by the groove on the back surface. Since the rate of intermittent drainage can be thus regulated by the groove on the back surface, the diameter of the intermittent drain through hole can be increased, and thereby the possible occurrence of clogging can be prevented.

Furthermore, the groove for regulating the rate of intermittent drainage is located on the back surface of the valve plate and not on the slide surface. Therefore, if the slide surface is worn away, its dimensions do not change. Therefore, according to this embodiment, the rate of intermittent drainage receives no influence of the wearing of the slide surface of the valve plate.

According to the variable displacement type piston machine of one embodiment, the slide surface of the valve plate is a part of a sphere, the back surface of the valve plate is a flat surface, and the slide surface of the cylinder block is a part of a sphere that fits to the slide surface of the valve plate.

In this case, the groove of the intermittent drain passage is provided on the flat back surface of the valve plate, and the intermittent drain through hole of the intermittent drain passage is opened at the slide surface of a part of a sphere of the valve plate. Therefore, it is not required to provide an intermittent drain passage groove on the slide surface of a part of a sphere. Therefore, the intermittent drain passage can be easily processed.

It is to be noted that the slide surface of the valve plate and the slide surface of the cylinder block are made to have spherical surfaces to be fitted to each other. Therefore, the area of the slide surfaces that slide on each other is increased to reduce the leak between the slide surfaces. Further, the surface pressure of the slide surfaces is reduced, so that they wear away less.

According to the variable displacement type piston machine of one embodiment, the intermittent drain passage is comprised of an intermittent drain groove which is provided on the slide surface of the valve plate and of which both ends are closed, and the intermittent drain groove is formed on the slide surface of the cylinder block and is always communicated with an annular groove communicated with a drain.

In this case, the intermittent drainage is discharged from the intermittent drain groove on the slide surface of the valve plate through the annular groove on the slide surface of the cylinder block to the drain. Therefore, since the energy is gradually attenuated while the intermittent drainage is discharged from the intermittent drain groove through the annular groove to the drain, noise is reduced.

Furthermore, the annular groove of the cylinder block is originally provided for balancing the pressure between the cylinder block and the valve plate. Therefore, the intermittent drain passage is formed by only the intermittent drain groove of which both ends are closed on the slide surface of the valve plate. Therefore, the intermittent drain passage can be formed easily at low cost.

According to the variable displacement type piston machine of one embodiment, the intermittent drain groove extends approximately in the radial direction of the valve plate, and an outer end portion of the intermittent drain groove is communicated with the annular groove.

In this case, the intermittent drain groove extends in the radial direction of the valve plate, and therefore, it can be easily processed.

BRIEF DESCRIPTION OF THE DRAWINGS

FIGS. 3A, 3B and 3C are graphs showing the flow rate of drainage flowing through an intermittent drain passage and the rate of back flow flowing through an oil guide groove;

BEST MODE FOR CARRYING OUT THE INVENTION

The present invention will be described in detail below based on its embodiments with reference to the accompanying drawings.

(First Embodiment)

Figure 1:
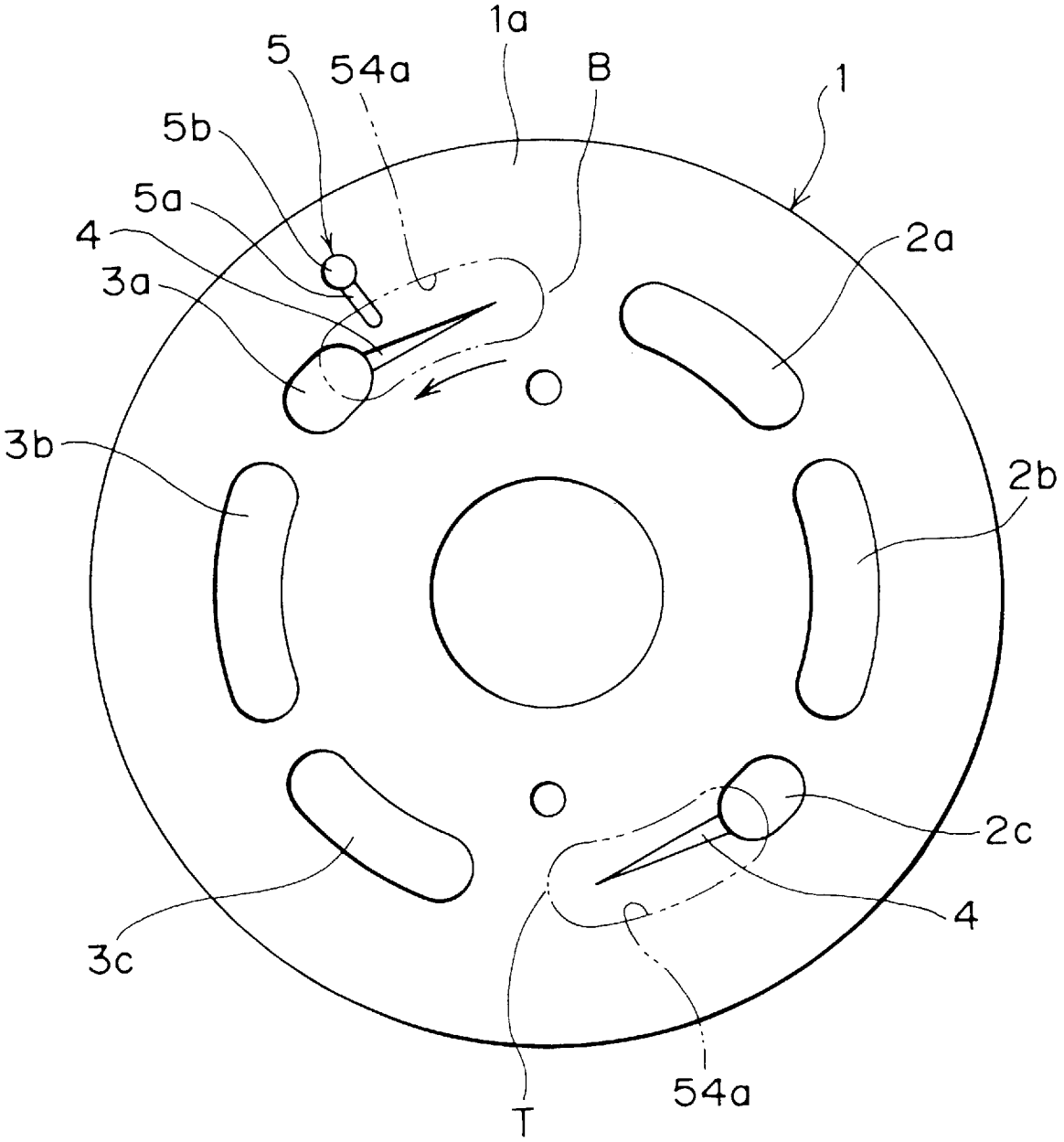
FIG. 1 is a front view of a valve plate of a variable displacement type piston pump according to a first embodiment of the present invention.
Figure 15:
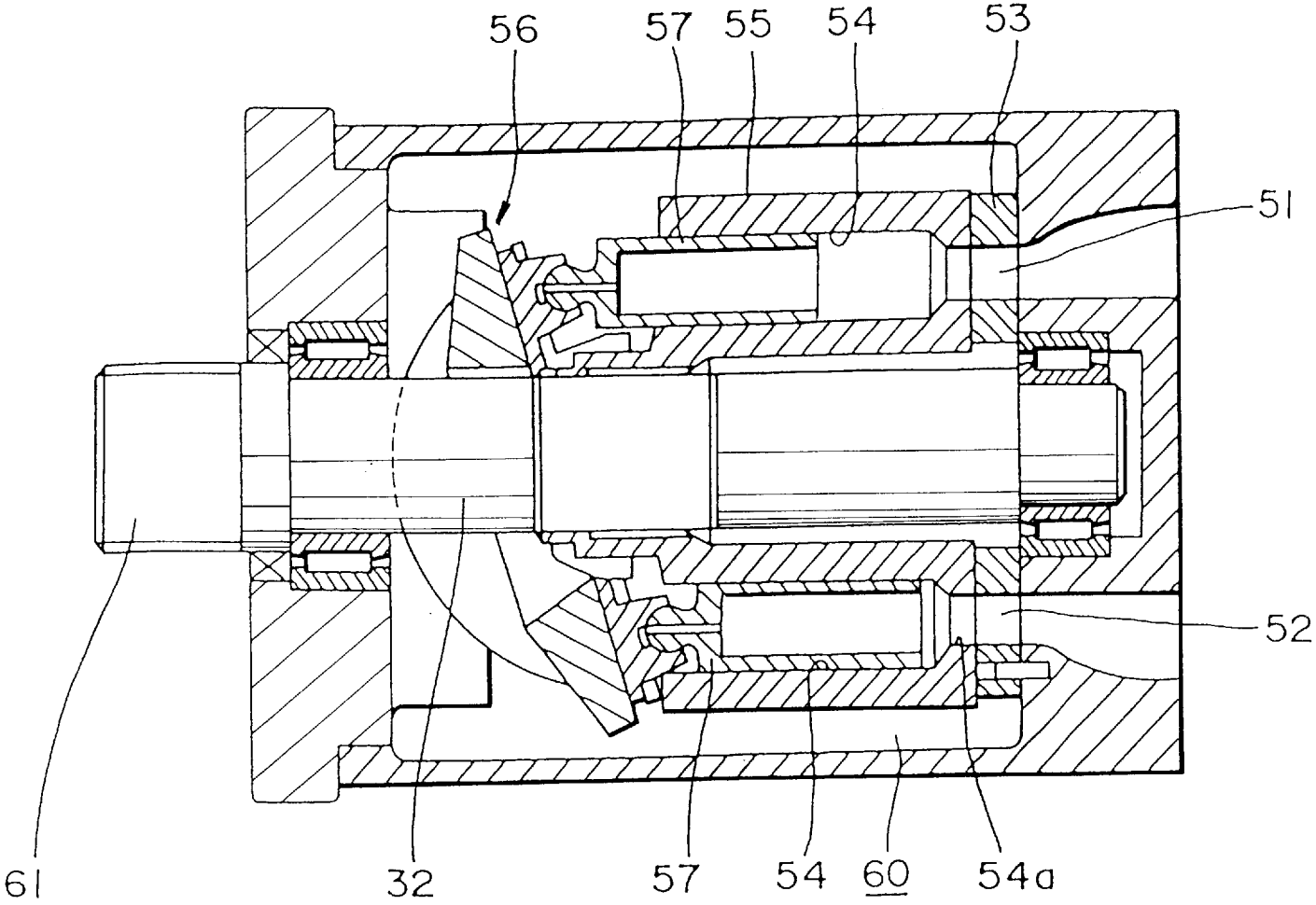
Fig. 15 PRIOR ART
FIG. 15 is a sectional view of a prior art variable displacement type piston pump.
Figure 16:
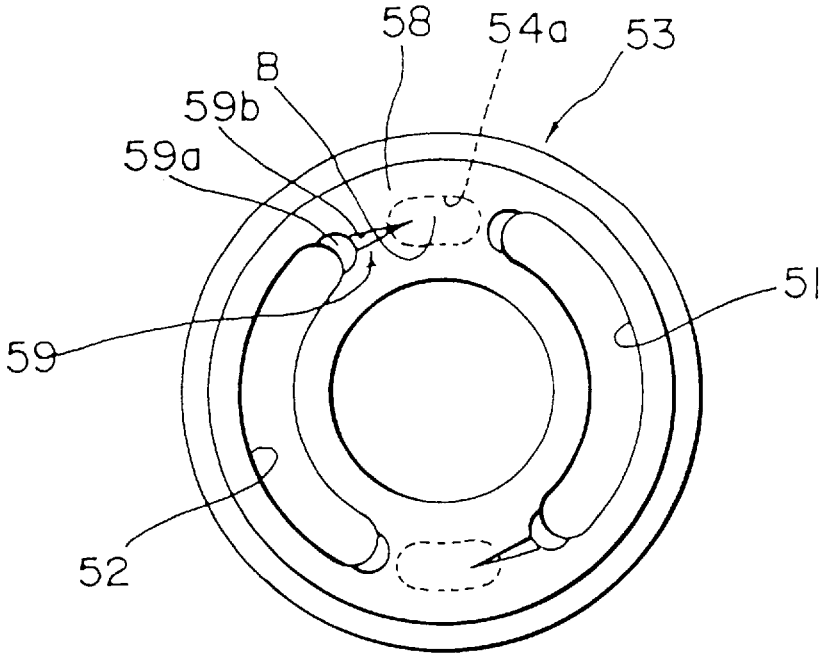
Fig. 16 PRIOR ART
FIG. 16 is a front view of a valve plate of the variable displacement type piston pump shown in FIG. 15.
Figure 17:
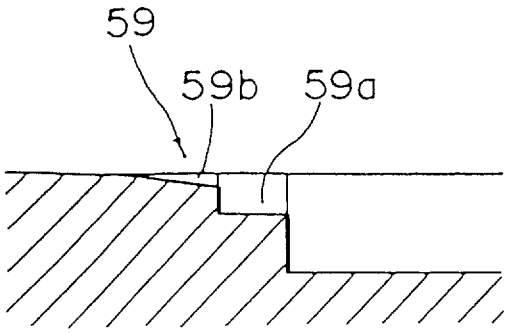
Fig. 17 PRIOR ART
FIG. 17 is a sectional view of a portion of an oil guide groove of the valve plate shown in FIG. 16.

FIG. 1 is a front view of a valve plate 1 of a variable displacement type piston pump according to a first embodiment of the present invention. This variable displacement type piston pump has entirely the same components as those of the prior art shown in FIG. 15 except for the valve plate 1. Therefore, FIG. 15 is referred to for these components.

As shown in FIG. 1, the valve plate 1 is provided with suction ports 2*a*, 2*b* and 2*c* which serve as low pressure ports and discharge ports 3*a*, 3*b* and 3*c* which serve as high pressure ports. The suction ports 2*a*, 2*b* and 2*c* are communicated with one another on the back surface side of the valve plate 1 though not shown. The discharge ports 3*a*, 3*b* and 3*c* are also communicated with one another on the back surface side of the valve plate 1 though not shown. Further, the slide surface la of the valve plate 1 is provided with a V-shaped oil guide groove 4 that extends from a discharge port 3*a* to the proximity of a bottom dead center B. Further, a V-shaped oil guide groove 4 that extends from the suction port 2*c* to a top dead center T is provided. Further, the slide surface 1*a* of the valve plate 1 is provided with an intermittent drain passage 5 located radially outwardly of a root portion of the oil guide groove 4 that extends from the discharge port 3*a*. The intermittent drain passage 5 is comprised of an intermittent drain groove 5*a* that extends radially and a through hole 5*b* that communicates with the intermittent drain groove 5*a* and axially penetrates the valve plate 1 to be communicated with a casing drain 60 as shown in FIG. 15. The intermittent drain passage 5 is directly communicated with neither the oil guide groove 4 nor the discharge port 3*a*. However, the intermittent drain passage 5 can communicate with the oil guide groove 4 and the discharge port 3*a* via the cylinder port 54*a* communicated with the cylinders 54 as follows. That is, according as the cylinder block 55 rotates in a direction as indicated by an arrow, the cylinder port 54*a* firstly communicates with only the oil guide groove 4 in the vicinity of the bottom dead center B. When the cylinder block 55 further rotates, the cylinder port communicates with both the oil guide groove 4 and the intermittent drain groove 5*a* of the intermittent drain passage 5. When the cylinder block 55 further rotates, the cylinder port communicates with the oil guide groove 4, the intermittent drain groove 5*a* and the discharge port 3*a*.

The variable displacement type piston pump having the above construction operates as follows.

Figure 2A:
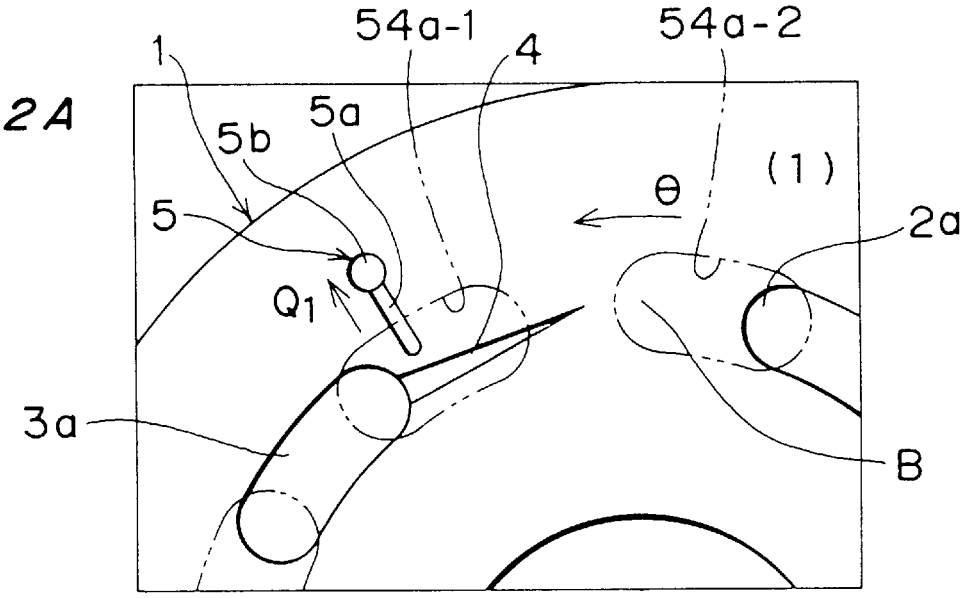
FIGS. 2A, 2B and 2C are diagrams for explaining an operation showing a positional relation between an intermittent drain passage and a cylinder port as shown in FIG. 1.

It is now assumed that the cylinder block 55 is rotating in the direction of the arrow while sliding on the valve plate 1 and cylinder ports 54*a*-1 and 54*a*-2 are located relative to the valve plate 1 as shown in FIG. 2A.

In this stage, the cylinder port 54*a*-1 has rotated by a specified angle from the bottom dead center B, and therefore, the pressure in the cylinder 54 (refer to FIG. 15) communicated with the cylinder port 54*a*-1 has already increased to a high pressure. Although the cylinder port 54*a*-1 overlaps and communicates with the discharge port 3*a*, the oil guide groove 4 and the intermittent drain groove 5*a*, the succeedingly running cylinder port 54*a*-2 does not communicate with the oil guide groove 4. Therefore, operating fluid is discharged by a flow rate $Q_1$ from the high pressure port 3*a* via the cylinder port 54*a*-1 to the intermittent drain groove 5*a*, and further this operating fluid changes its direction at the through hole 5*b* to be guided to the back surface side of the valve plate 1 and then discharged to the casing drain 60. That is, in the state shown in FIG. 2A, the drainage is discharged by the flow rate $Q_1$ from the discharge port 3*a* via the cylinder port 54*a*-1 and the intermittent drain passage 5 to the casing drain 60. This state is indicated by (1) in FIG. 3A.

When the operating fluid is discharged as a drainage while flowing from the intermittent drain groove 5*a* to the through hole 5*b*, the flowing direction of the drainage is changed by an angle of 90 degrees. Consequently, its energy is consumed to reduce the noise in discharging the drainage.

Figure 2B:
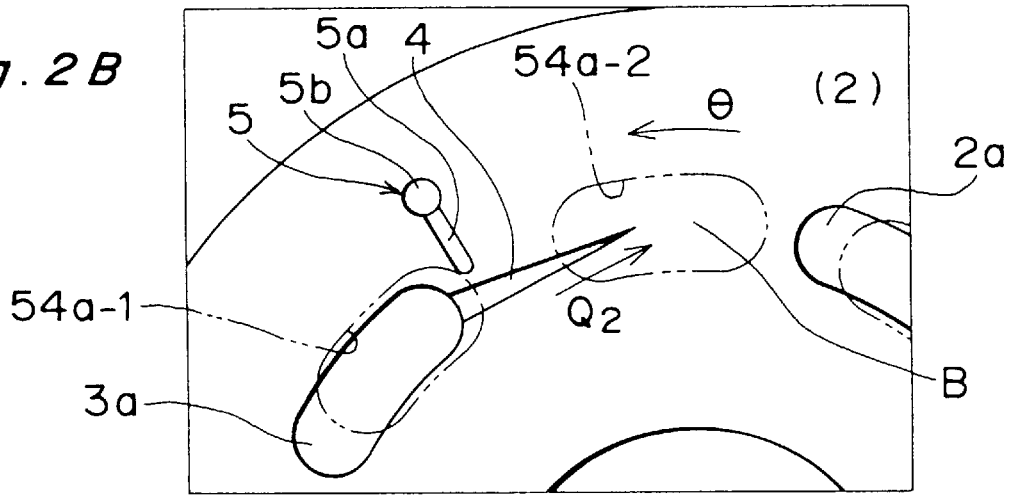

It is next assumed that the cylinder block 55 further rotates to enter into a state as shown in FIG. 2B.

In this stage, the cylinder port 54*a*-2 that is located in the vicinity of the bottom dead center and is succeedingly running overlaps with the oil guide groove 4 and communicates therewith. On the other hand, the pressure inside the cylinder 54 communicated with the cylinder port 54*a*-2 has not increased sufficiently because only a short time has elapsed since it entered into a discharge stroke. Therefore, the operating fluid gradually flows back by the flow rate $Q_2$ from the discharge port 3*a* to the cylinder port 54*a*-2 through the oil guide groove 4. Therefore, the pressure inside the cylinder 54 communicated with the cylinder port 54*a*-2 gradually increases. Accordingly, the pressure inside the cylinder 54 does not increase abruptly when shifting from a suction stroke to the discharge stroke and the pressure at the discharge port 3*a* is not reduced abruptly, the noise and vibration can be reduced.

On the other hand, in this stage, the intermittent drain groove 5*a* of the intermittent drain passage 5 starts to separate from the preceding cylinder port 54*a*-1, so that the discharge of the operating fluid passing through the intermittent drain passage 5 is stopped. This state is shown in the region (2) of FIG. 3B.

Figure 2C:
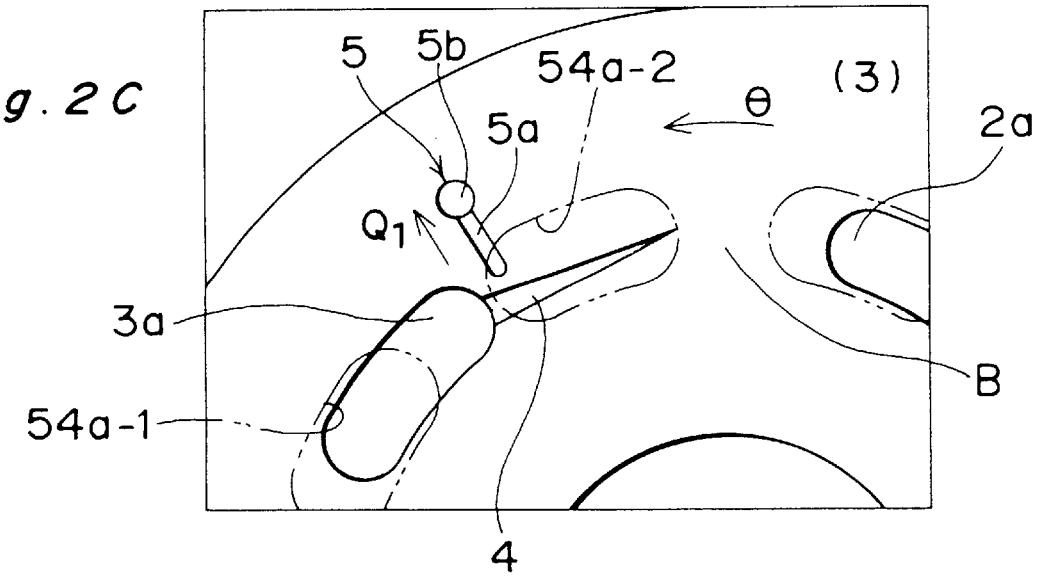

It is next assumed that the cylinder block 55 further rotates to enter into a state as shown in FIG. 2C.

In this stage, the pressure inside the cylinder 54 communicated with the succeeding cylinder port 54*a*-2 has been already increased to a high pressure, and therefore, the back flow from the discharge port 3*a* to the cylinder port 54*a*-2 has been already disappeared. On the other hand, since the cylinder port 54*a*-2 overlaps with the intermittent drain groove 5*a* and the oil guide groove 4 and communicates therewith, the operating fluid is discharged by the flow rate $Q_1$ from the discharge port 3*a* to the casing drain 60 through the intermittent drain groove 5*a* and the through hole 5*b*. This state is shown in the region (3) of FIG. 3A.

Figure 3A:
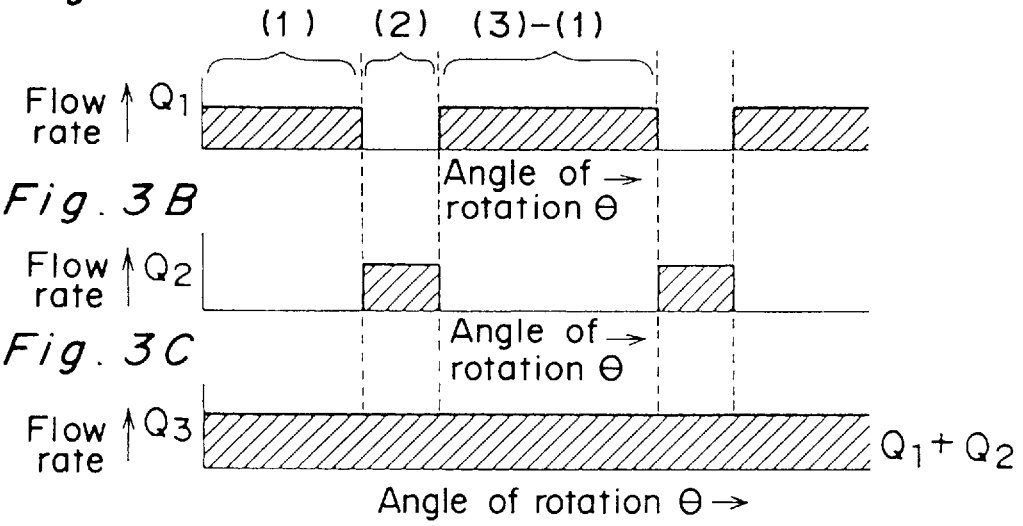

Thus, when the back flow from the discharge port 3*a* to the cylinder port 54*a* through the oil guide groove 4 is generated, basically the intermittent drain passage 5 does not overlap with the cylinder port 54*a* to be interrupted, so that it does not discharge the operating fluid. When the pressure inside the cylinder 54 has increased and the back flow disappears, the intermittent drain passage 5 overlaps with the cylinder port 54*a* and communicates with the discharge port 3*a* via the cylinder port 54*a*, so that it discharges the operating fluid to the casing drain 60. That is, as shown in FIGS. 3A and 3B, the back flow $Q_2$ from the discharge port 3*a* to the cylinder 54 and the drainage $Q_1$ from the discharge port 3*a* to the intermittent drain passage 5 are alternately formed, so that a constant amount of fluid $Q_3$ is discharged from the discharge port 3*a* without variation throughout the entire stroke process as shown in FIG. 3C. Therefore, the pulsation on the discharge ports 3*a*, 3*b* and 3*c* side is reduced and the vibration and noise are reduced, so that the operation characteristic of the whole machine improves.

Figure 4:
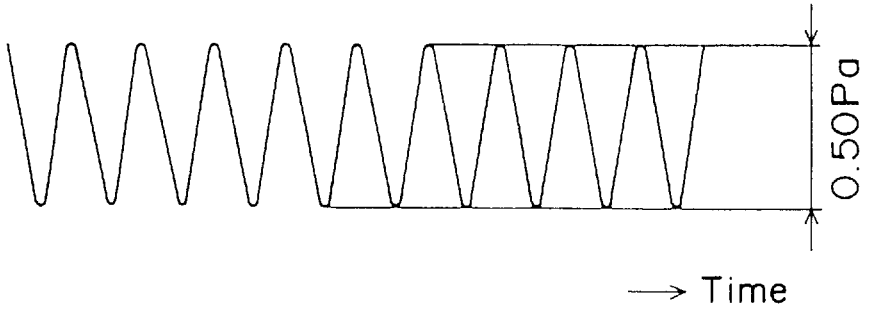
Fig. 4 PRIOR ART
FIG. 4 is a graph showing a pulsation of a prior art.
Figure 5:
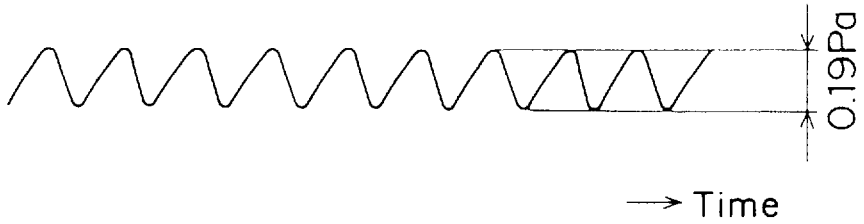
FIG. 5 is a graph showing a pulsation of the first embodiment.

FIG. 5 shows the magnitude (0.19Pa) of the pulsation of the pressure on the discharge ports 3*a*, 3*b* and 3*c* side of the first embodiment, and tells that the magnitude (0.19Pa) of the pulsation of the first embodiment has been reduced to 40% or less in comparison with the magnitude (0.50Pa) of the pulsation of the prior art as shown in FIG. 4.

Figure 9:
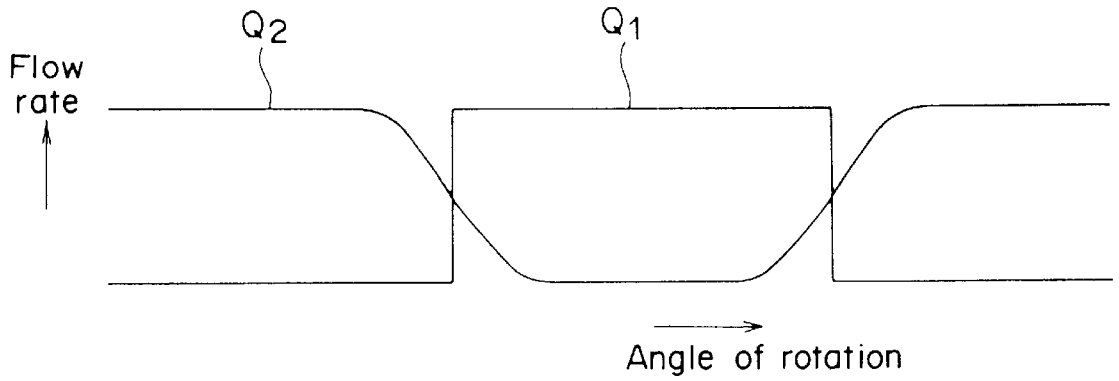
FIG. 9 is a graph showing the flow rate of a drainage flowing through a drain passage and the rate of back flow flowing through the oil guide groove of the first embodiment.

FIG. 9 shows the appearance and disappearance of the back flow $Q_2$ passing through the oil guide groove 4 in accordance with an angle of rotation θ of the cylinder block 55 and tells that the drain flow rate $Q_1$ flowing through the intermittent drain passage 5 is controlled in accordance with the appearance and disappearance of the back flow $Q_2$.

Furthermore, in this variable displacement type piston pump, the intermittent drain passage 5 is closed to stop the discharge of drainage when a back flow is generated in the oil guide groove 4. Therefore, in comparison with the one in which the drainage is always discharged, an improved volume efficiency is achieved.

Furthermore, in this variable displacement type piston pump, the intermittent drain groove 5*a* is provided on the slide surface 1*a* of the valve plate 1. Therefore, the intermittent drain groove 5*a* scarcely clogs with dirt or the like due to the sliding motion and minute vibration of the cylinder block 55 relative to the slide surface 1*a*, and if it is clogged, the dirt or the like can be easily removed.

(Second Embodiment)

FIGS. 6A, 6B, 6C, 7A, 7B, 7C, 8A and 8B are diagrams for explaining the operation of a variable displacement type piston pump according to a second embodiment of the present invention. This variable displacement type piston pump differs from the first embodiment only in that the cylinder block 55 shown in FIG. 15 is provided with nine cylinders 54 and nine cylinder ports 54*a* at regular intervals of 40 degrees and in the structure of an intermittent drain passage 15. The components having the same constructions as those of the first embodiment are denoted by the same reference numerals as those of the first embodiment, and no description is provided therefor.

Figure 6A:
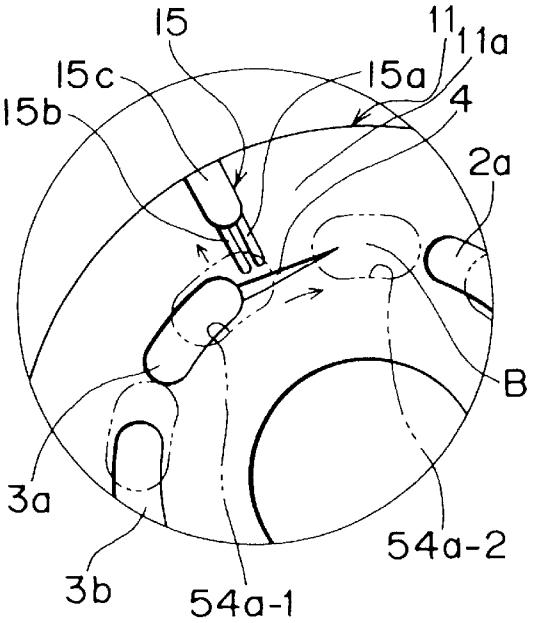
FIGS. 6A, 6B and 6C are views showing a positional relation between an intermittent drain passage and a cylinder port of a second embodiment.

As shown in FIG. 6A, a slide surface 11*a* of a valve plate 11 of the variable displacement type piston pump of the second embodiment is provided with an intermittent drain passage 15 independently (separately) for the discharge port 3*a* and the oil guide groove 4. This intermittent drain passage 15 is comprised of thin first and second intermittent drain grooves 15*a* and 15*b* that are extended radially in parallel with each other and a wide third intermittent drain groove 15*c* that is communicated with the first and second intermittent drain grooves 15*a* and 15*b*, extended radially and opened at a peripheral surface of the valve plate 11.

Since the cylinder ports 54*a* are provided at regular intervals of 40 degrees, the cylinder ports 54*a* are repetitively located in the same positions with respect to the discharge ports 3*a*, 3*b* and 3*c*, the suction ports 2*a*, 2*b* and 2*c* and the intermittent drain passage 15 at 40 degrees of rotation of the cylinder block 55.

The positional relation of the cylinder ports 54*a*-1 and 54*a*-2 relative to the first and second intermittent drain grooves 15*a* and 15*b*, the oil guide groove 4 and the discharge port 3*a* is as shown in FIGS. 6A, 6B, 6C, 7A, 7B, 7C, 8A and 8B.

As shown in FIG. 6A, at zero degree of rotation, the leading end of the oil guide groove 4 overlaps with the cylinder port 54*a*-2 to communicate therewith, while the preceding cylinder port 54*a*-1 overlaps with the discharge port 3*a* and the first and second intermittent drain grooves 15*a* and 15*b* to communicate therewith. Therefore, in this stage, the operating fluid inside the high pressure discharge port 3*a* gradually flows into the succeeding cylinder port 54*a*-2 and cylinder 54 through the oil guide groove 4 to ease the pressure variation inside the cylinder 54, and is discharged in the radial direction through the preceding cylinder port 54*a*-1, the first and second intermittent drain grooves 15*a* and 15*b* and the third intermittent drain groove 15*c* to be discharged to the casing drain 60. The sum of the amount of the operating fluid flowing back through the oil guide groove 4 and the amount of the operating fluid discharged from the third intermittent drain groove 15*c* is approximately constant.

Figure 6B:
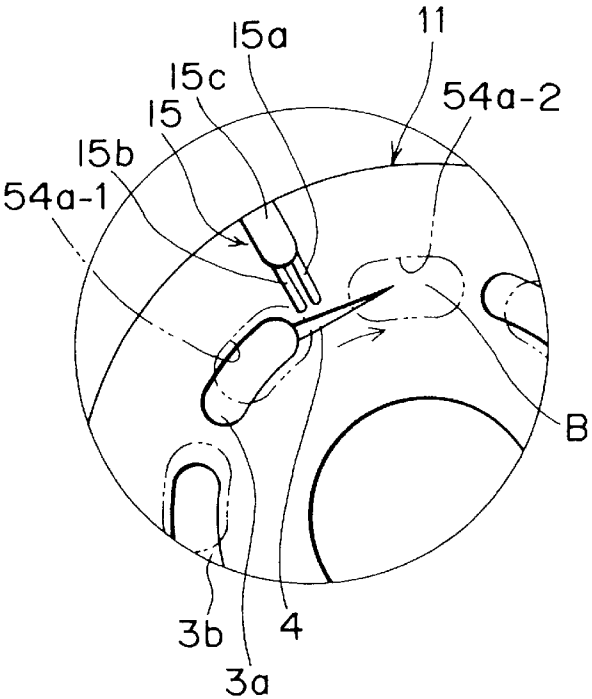

When the cylinder block 55 has rotated by five degrees from the state shown in FIG. 6A to enter into a state as shown in FIG. 6B, the preceding cylinder port 54*a*-1 and the second intermittent drain groove 15*b* separate from each other, while the overlap of the oil guide groove 4 with the succeeding cylinder port 54*a*-2 increases. Therefore, the drainage from the discharge port 3*a* to the drain passage 15 disappears, while the rate of back flow passing through the oil guide groove 4 increases. The rate of back flow is approximately equal to the sum of the amount of operating fluid flowing back through the oil guide groove 4 and the amount of operating fluid discharged from the third intermittent drain groove 15*c* in FIG. 6A.

Figure 6C:
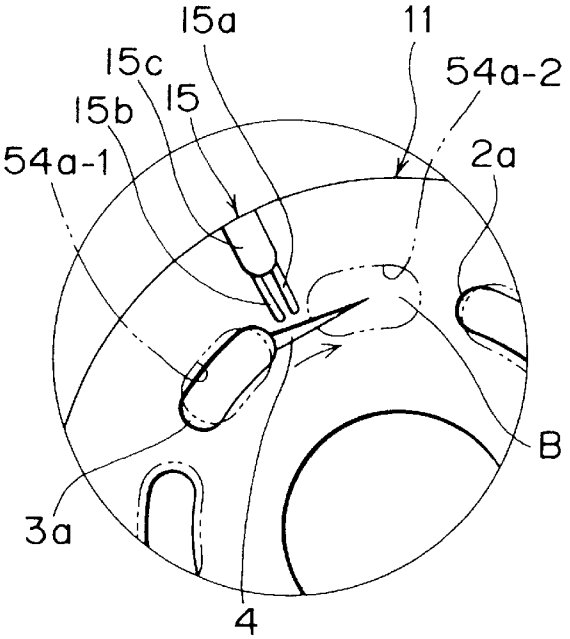

A state as shown in FIG. 6C is the state in which the cylinder block 55 has rotated by ten degrees, where both the preceding cylinder port 54*a*-1 and the succeeding cylinder port 54*a*-2 are completely separated apart from the drain passage 15, so that only a back flow passing through the oil guide groove 4 from the discharge port 3*a* to the cylinder port 54*a*-2 is generated. In this stage, the overlap of the oil guide groove 4 with the cylinder port 54*a*-2 becomes greater than that of the state shown in FIG. 6B. However, the pressures in the succeeding cylinder port 54*a*-2 and cylinder 54 are increased, so that a difference between the pressure on the discharge port 3*a* side and the pressure on the cylinder 54 side is made smaller than that of the state shown in FIG. 6B. Therefore, the rate of back flow shown in FIG. 6C is approximately equal to the rate of back flow shown in FIG. 6B.

Figures 7A, 7B, 7C:
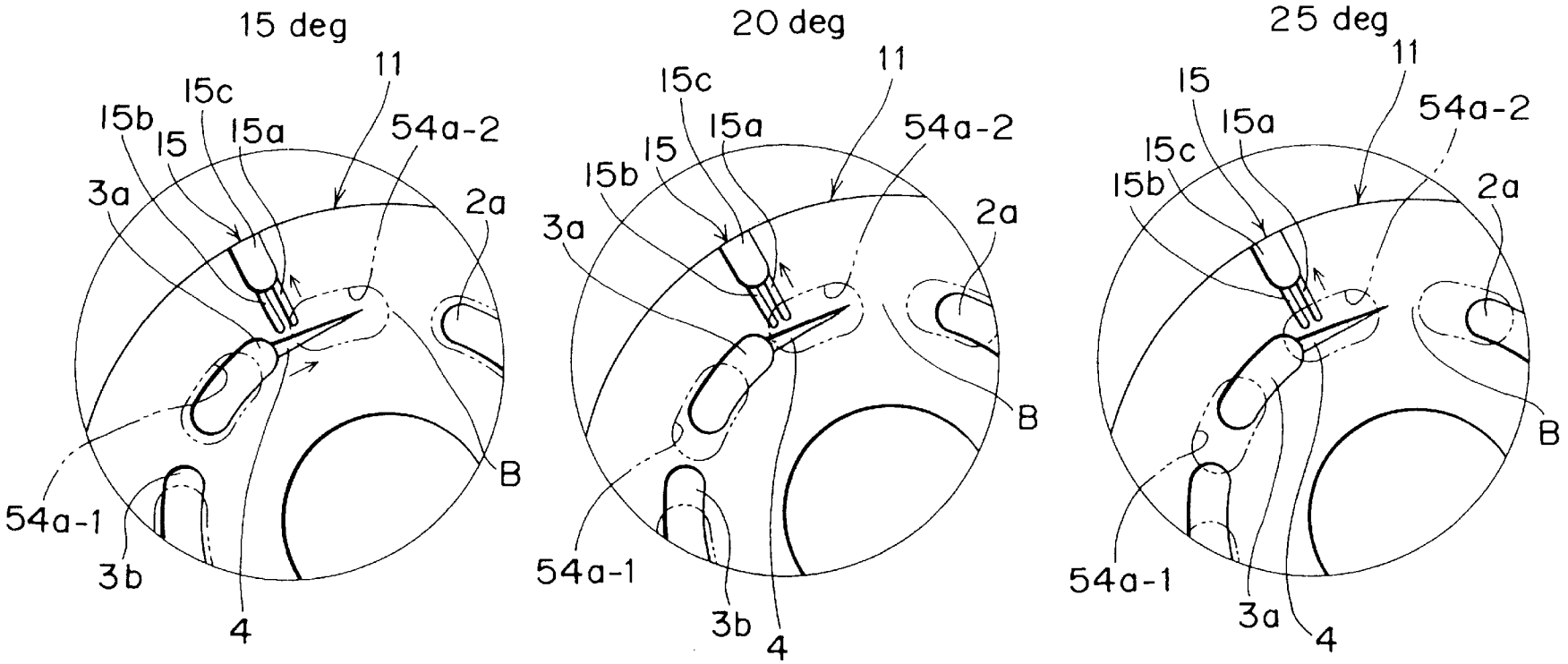
FIGS. 7A, 7B and 7C are diagrams showing a positional relation between the intermittent drain passage and the cylinder port of the second embodiment.

When the cylinder block 55 has rotated by 15 degrees to enter into a state as shown in FIG. 7A, the succeeding cylinder port 54*a*-2 greatly overlaps with the oil guide groove 4 and overlaps with the first intermittent drain groove 15*a* to communicate therewith. In this stage, the pressure in the succeeding cylinder port 54*a*-2 and cylinder 54 communicated with it have been increased to be greater than that in the state shown in FIG. 6C, the rate of back flow flowing from the discharge port 3*a* through the oil guide groove 4 to the succeeding cylinder port 54*a*-2 reduces. However, since the succeeding cylinder port 54*a*-2 communicates with the first intermittent drain groove 15*a* in this stage, the amount of drainage passing through the first intermittent drain groove 15*a* compensates for the reduction in the back flow. Therefore, in FIG. 7A, the amount of operating fluid flowing from the discharge port 3*a* to the succeeding cylinder 54 and first intermittent drain groove 15*a* is approximately equal to the rate of back flow in the oil guide groove 4 in the state shown in FIG. 6C.

When the cylinder block 55 has rotated by 20 degrees to enter into a state as shown in FIG. 7B, the pressures inside the succeeding cylinder port 54*a*-2 and cylinder 54 communicated with it increase to be approximately equal to the pressure inside the discharge port 3*a*, so that the operating fluid stops entering into the cylinder 54 from the oil guide groove 4. However, the succeeding cylinder port 54*a*-2 overlaps with both the first and second intermittent drain grooves 15*a* and 15*b* to communicate therewith, and therefore, the amount of operating fluid discharged through the first and second intermittent drain grooves 15*a* and 15*b* to the casing drain 60 increases to be greater than the amount of operating fluid discharged through only the first intermittent drain groove 15*a* to the casing drain 60 as shown in FIG. 7A. Consequently, in the state shown in FIG. 7B, the amount of operating fluid discharged from the discharge port 3*a* to the casing drain 60 via the cylinder port 54*a*-2 and the first and second intermittent drain grooves 15*a* and 15*b* is approximately equal to the amount of operating fluid flowing from the discharge port 3*a* to the succeeding cylinder 54 and the first intermittent drain groove 15*a* in the state shown in FIG. 7A.

Figure 8B:
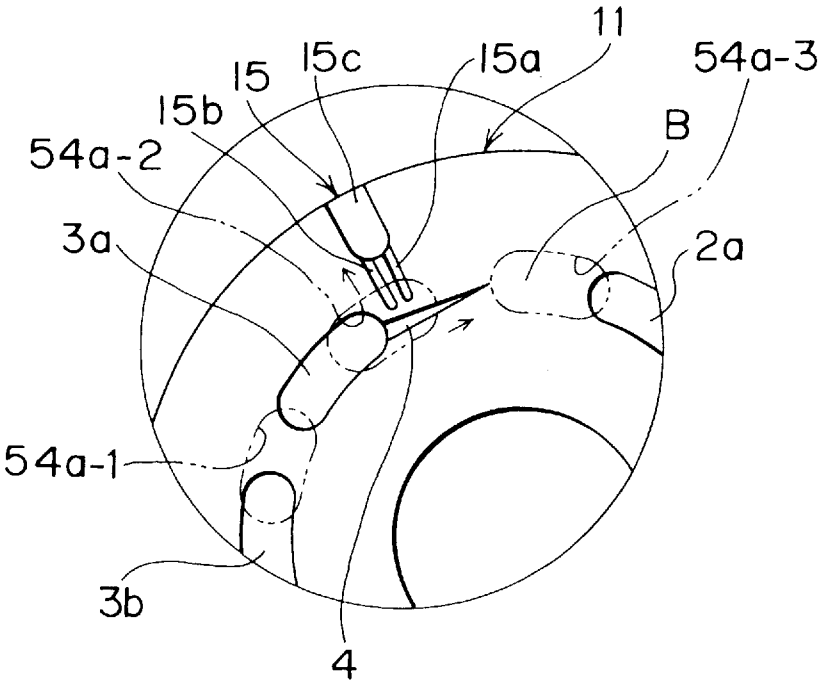
FIGS. 8A and 8B are diagrams showing a positional relation between the intermittent drain passage and the cylinder port of the second embodiment.
Figure 8A:
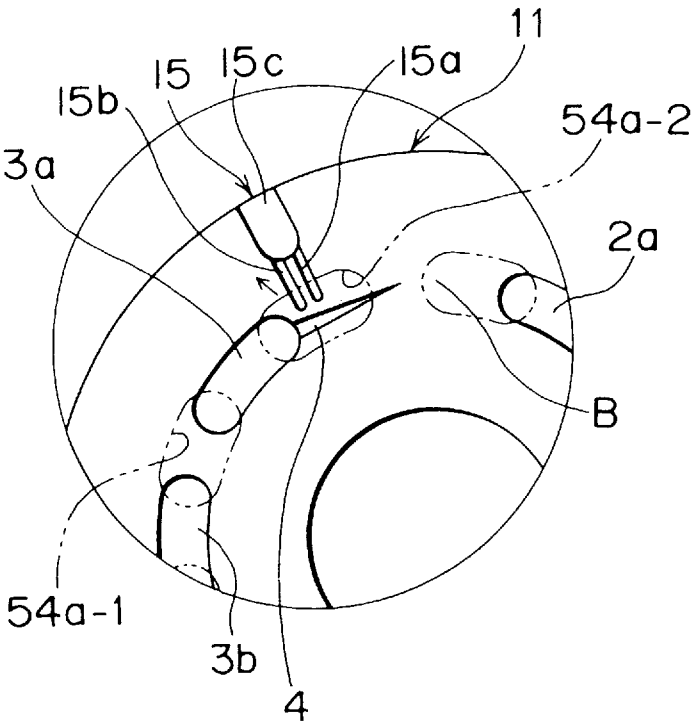

FIG. 7C shows a state in which the cylinder block 55 has rotated by 25 degrees, while FIG. 8A shows a state in which the cylinder block 55 has rotated by 30 degrees. In the states shown in FIGS. 7C and 8A, the pressures inside the succeeding cylinder port 54*a*-2 and the cylinder 54 communicated with it become approximately equal to the pressure on the discharge port 3*a* side, so that the back flow from the oil guide groove 4 to the cylinder 54 disappears. On the other hand, the first and second intermittent drain grooves 15*a* and 15*b* communicate with the succeeding cylinder port 54*a*-2, and therefore, the operating fluid is discharged from the discharge port 3*a* to the casing drain 60 via the cylinder port 54*a*-2, the oil guide groove 4, the first and second intermittent drain grooves 15*a* and 15*b* and the third intermittent drain groove 15*c*. The amount of operating fluid to be discharged is approximately equal to the amount of operating fluid discharged to the casing drain 60 in FIG. 7B.

FIG. 8B shows a state in which the cylinder block 55 has rotated by 35 degrees. When the cylinder block rotates further than 35 degrees, though not shown, the succeeding cylinder port 54*a*-2 separates from the first intermittent drain groove 15*a* and overlaps with the second intermittent drain groove 15*b*, the oil guide groove 4 and the discharge port 3*a* to communicate therewith. Consequently, only the second intermittent drain groove 15*b* communicates with the cylinder port 54*a*-2, and therefore, the amount of operating fluid discharged from the discharge port 3*a* to the casing drain 60 via the second intermittent drain groove 15*b* and the third intermittent drain groove 15*c* reduces to be smaller than the amount of operating fluid discharged to the casing drain 60 in FIG. 8A. However, in this stage, the oil guide groove 4 communicates with a cylinder port 54*a*-3 subsequent to the cylinder port 54*a*-2, and therefore, a back flow flowing through the oil guide groove 4 to the cylinder port 54*a*-3 is generated to compensate for the reduction of the operating fluid discharged to the casing drain 60.

Thus, by providing the state in which the first and second intermittent drain grooves 15*a* and 15*b* are disconnected from the discharge port 3*a*, the state in which only one of the first and second intermittent drain grooves 15*a* and 15*b* is communicated with the discharge port 3*a* via the cylinder port 54*a*, and the state in which both the first and second intermittent drain grooves 15*a* and 15*b* are communicated with the discharge port 3*a* via the cylinder port 54*a* according to the presence and absence and the magnitude of the back flow flowing through the oil guide groove 4, the presence and absence and the magnitude of the drainage passing through the intermittent drain passage 15 are controlled. Therefore, the sum of the rate of back flow passing through the oil guide groove 4 and the rate of drainage passing through the intermittent drain passage 15 can be always made approximately constant. Consequently, the pulsation in the discharge ports 3*a*, 3*b* and 3*c* is made small to reduce the noise and vibration, and the operation characteristic of the whole apparatus can be made satisfactory.

Figure 10:
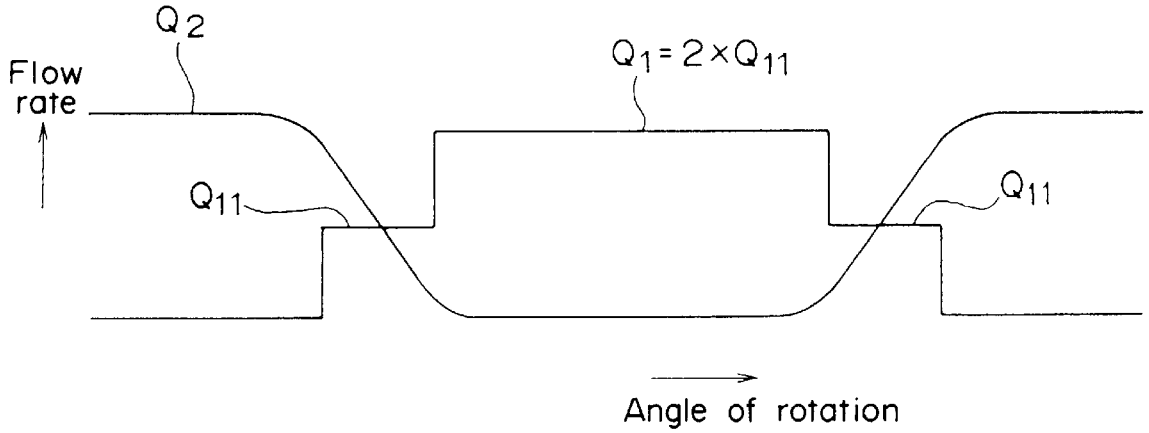
FIG. 10 is a graph showing the flow rate of drainage flowing through a drain passage and the rate of back flow flowing through the oil guide groove of the second embodiment.

FIG. 10 shows a state in which the increase and decrease of the rate of back flow passing through the oil guide groove 4 are compensated by controlling the drain flow rate in two steps by the first and second intermittent drain grooves 15*a* and 15*b* of the second embodiment. $Q_2$ represents the rate of back flow passing through the oil guide groove 4. $Q_{11}$ represents a drain flow rate generated by only one of the first and second intermittent drain grooves 15*a* and 15*b*. $Q_1=2\times Q_{11}$represents a drain flow rate generated by both the first intermittent drain groove 15*a* and the second intermittent drain groove 15*b*. Since the drain flow rate is thus controlled in two steps, the presence and absence and the increase and decrease of the back flow in the oil guide groove 4 can be compensated with higher accuracy than in the first embodiment shown in FIG. 9.

Furthermore, according to the second embodiment, when the rate of back flow in the oil guide groove 4 is great, the intermittent drain passage 15 is closed so as not to discharge the drainage. Therefore, in comparison with the structure in which a drainage is always generated, the volume efficiency improves.

Furthermore, according to the second embodiment, the intermittent drain passage 15 is provided by only the first, second and third intermittent drain grooves 15*a*, 15*b* and 15*c* on which the cylinder block 55 slides while vibrating minutely. Therefore, the intermittent drain passage 15 is scarcely clogged with dirt or the like, and if it is clogged, the dirt or the like can be easily removed.

Furthermore, according to the second embodiment, since the intermittent drain passage 15 is comprised of only the first, second and third intermittent drain grooves 15*a*, 15*b* and 15*c*, it is easily processed. Furthermore, since the first and second intermittent drain grooves 15*a* and 15*b* are parallel to each other, they are easily processed.

According to the second embodiment, a total of two first and second intermittent drain grooves 15*a* and 15*b* are opened and closed relative to the discharge port 3*a* depending on the position of the cylinder port 54*a*. However, three or more intermittent drain grooves (not shown) may be opened and closed relative to the discharge port depending on the position of the cylinder port.

Furthermore, it is acceptable to provide the intermittent drain passage with no groove and constitute it by only one or a plurality of through holes penetrating the valve plate. In this case, it is easily processed.

(Third Embodiment)

Figures 11A, 11B, 11C:
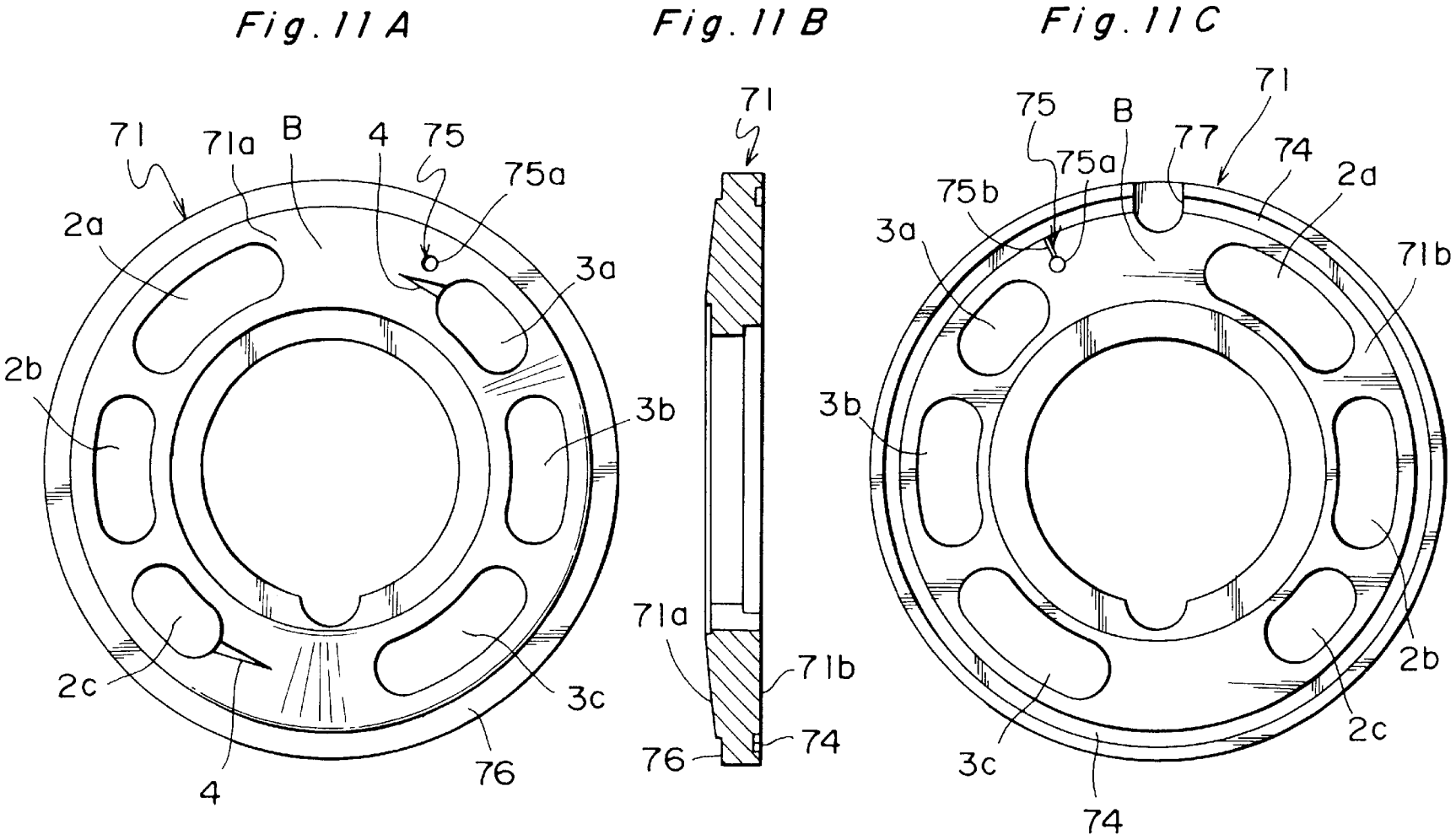
FIGS. 11A, 11B and 11C are a front view, a sectional view and a rear view of a valve plate of a third embodiment.

FIGS. 11A, 11B and 11C show a third embodiment. In FIGS. 11A, 11B and 11C, the components having the same constructions as those of the first and second embodiments are denoted by the same reference numerals, and no description is provided therefor.

As shown in FIG. 11B, this valve plate 71 has a first surface i.e. a slide surface 71*a* comprised of a part of a sphere, and its back surface 71*b* is comprised of a flat surface. Then, as shown in FIG. 11A, the valve plate 71 is provided with discharge ports 3*a*, 3*b* and 3*c* which are high pressure ports, suction ports 2*a*, 2*b* and 2*c* which are low pressure ports and a V-shaped oil guide groove 4. They have the same constructions as those of the first embodiment and perform the same operations. A large-diameter intermittent drain through hole 75*a* is provided at a radially outer portion of the valve plate 4 with respect to the oil guide groove 4 in the vicinity of the bottom dead center B of the slide surface 71*a* of the valve plate 71. As shown in FIG. 11C, the back surface 71*b* of the valve plate 11 is provided with a radial groove 75*b* communicated with the opening of the intermittent drain through hole 75*a*. An outer end of the radial groove 75*b* is communicated with an annular groove 74 provided on the back surface 71*b*, and the annular groove 74 is further communicated with a drain (not shown) by way of a cut portion 77. Therefore, the intermittent drain through hole 75*a* is communicated with the drain via the radial groove 75*b*, the annular groove 74 and the cut portion 77. The intermittent drain through hole 75*a* and the radial groove 75*b* constitute an intermittent drain passage 75. In an initial stage in which the discharge port 3*a* and a cylinder port (not shown) are communicated with each other via the oil guide groove 4, the intermittent drain through hole 75*a* of the intermittent drain passage 75 communicates with none of the discharge port 3*a*, the oil guide groove 4 and the cylinder port. When the cylinder block (not shown) is further rotated, it communicates with the discharge port 3*a* via the cylinder port. When a back flow to the oil guide groove 4 is taking place, the intermittent drain passage 75 is closed. When the back flow to the oil guide groove 4 disappears, the intermittent drain passage 75 is made to communicate with the discharge port 3*a* via the cylinder port so as to discharge the operating fluid from the discharge port 3*a* to the drain. Therefore, the pulsation inside the discharge ports 3*a*, 3*b* and 3*c* is reduced, and the noise and vibration are reduced.

It is to be noted that an annular stepped portion 76 is provided at a peripheral portion of the slide surface 71*a* of the valve plate 71.

According to the third embodiment, the diameter of the intermittent drain through hole 75*a* is increased to regulate the rate of intermittent drainage by the groove 75*b* of the back surface 71*b*. Since the rate of intermittent drainage is thus regulated by the radial groove 75*b* of the back surface 71*b*, the diameter of the intermittent drain through hole 75*a* opened at the slide surface 71*a* is increased, so that the possible clogging of the intermittent drain through hole 75*a* can be prevented.

Furthermore, the groove 75*b* for regulating the rate of intermittent drainage exists on the back surface 71*b* of the valve plate 71 and not on the slide surface 71*a*, and therefore, if the slide surface 71*a* is worn away, its dimensions do not change. Therefore, the rate of intermittent drainage receives no influence of the wearing of the slide surface 71*a* of the valve plate 71.

Furthermore, the groove 75*b* of the intermittent drain passage 75 is provided on the back surface 71*b* that is the flat surface of the valve plate 71, while the intermittent drain through hole 75*a* of the intermittent drain passage 75 is opened at the slide surface 71*a* that is a part of a sphere of the valve plate 71. Therefore, it is not required to provide the slide surface 71*a* that is a part of a sphere with the groove 75*b* for regulating the rate of intermittent drainage at the intermittent drain passage 75. Therefore, the intermittent drain passage 75 can be easily processed.

The slide surface 71*a* of the valve plate 71 and the slide surface of the cylinder block are made to have spherical surfaces that abut on each other. Therefore, the area of the slide surfaces that slide on each other is increased, so that the leak from between the slide surfaces is reduced and the surface pressure of the slide surfaces is reduced, causing them to wear less.

(Fourth Embodiment)

Figure 13:
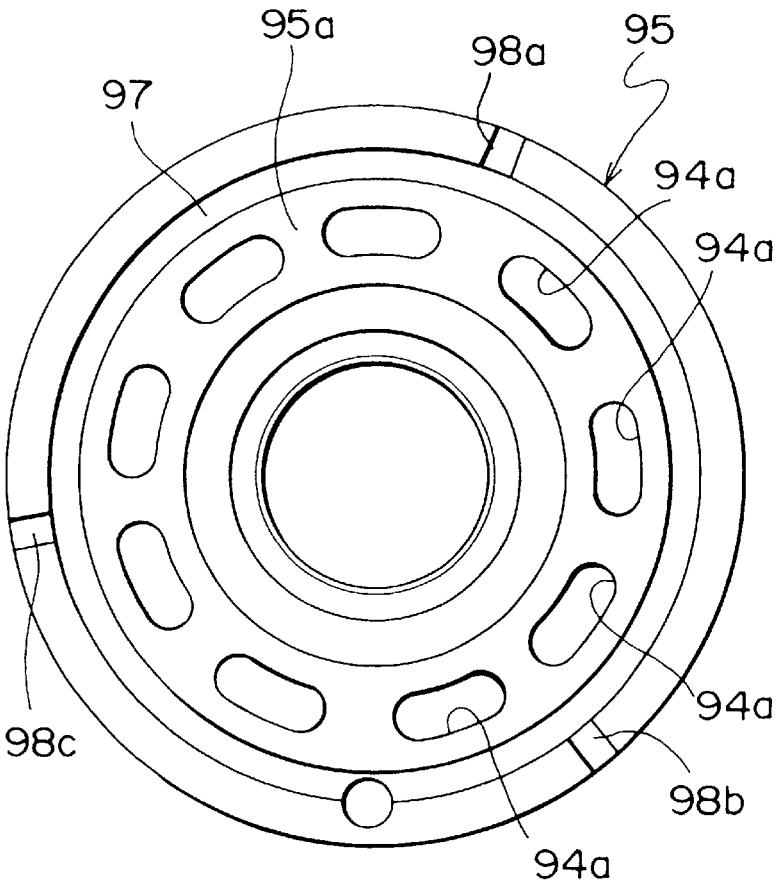
FIG. 13 is a view showing a slide surface of a cylinder block of the fourth embodiment.
Figure 12:
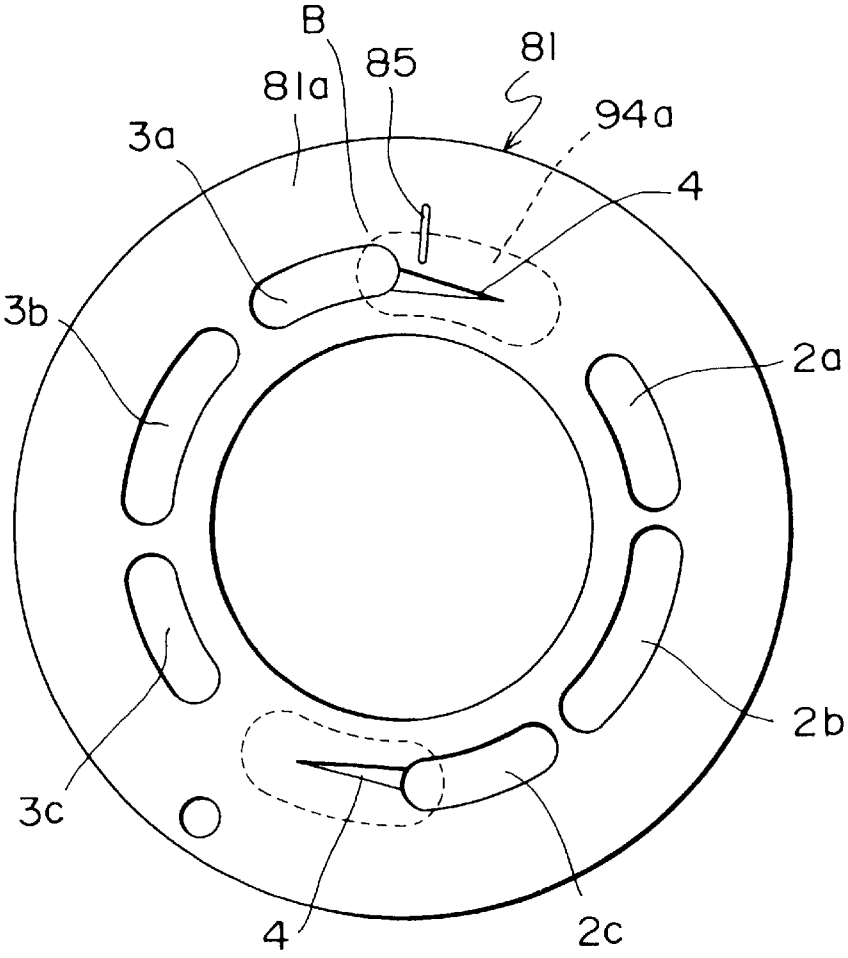
FIG. 12 is a front view of a valve plate of a fourth embodiment.
Figure 14:
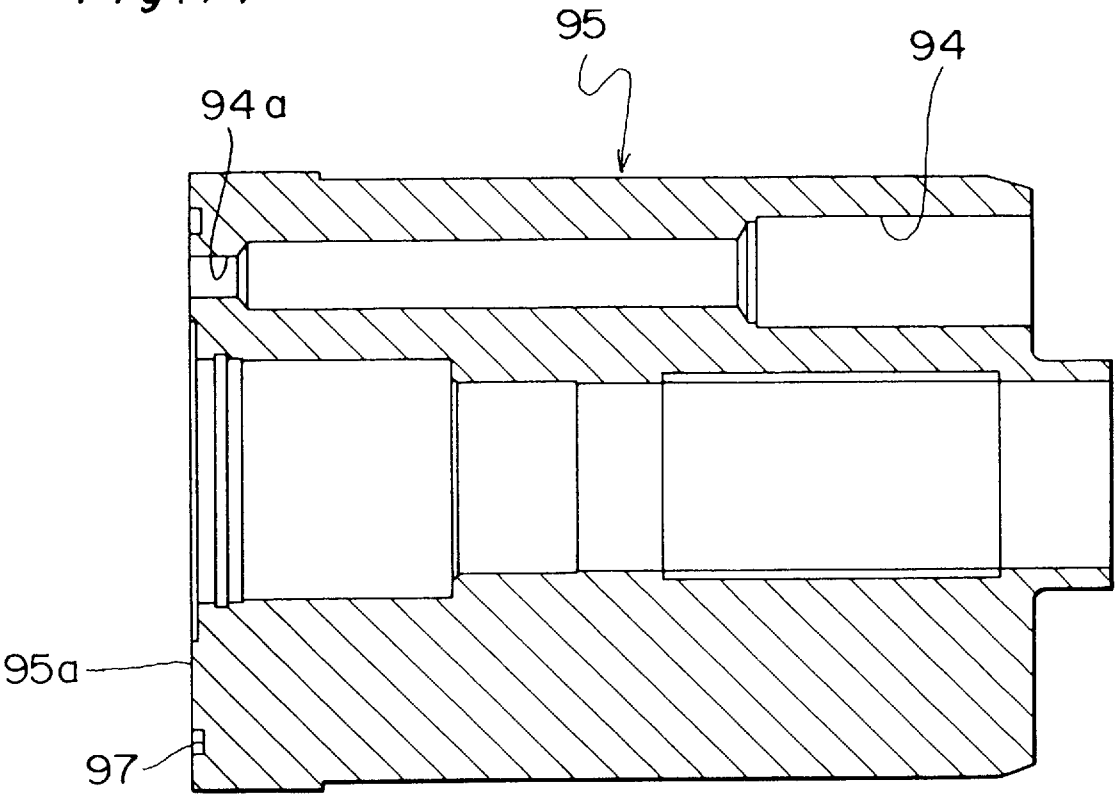
FIG. 14 is a sectional view of the cylinder block of the fourth embodiment.

FIGS. 12, 13 and 14 show a fourth embodiment.

As shown in FIG. 12, this valve plate 81 is provided with discharge ports 3*a*, 3*b* and 3*c*, suction ports 2*a*, 2*b* and 2*c* and a V-shaped oil guide groove 4. They have the same constructions as those of the first embodiment and perform the same operations. An intermittent drain groove 85 of which both ends are closed and which radially extends is provided at a radially outer portion of the valve plate 4 with respect to the oil guide groove 4 in the vicinity of the bottom dead center B of a slide surface 81*a* of the valve plate 81. The intermittent drain groove 85 singly constitutes the intermittent drain passage 85. The intermittent drain groove 85 has the same communicational relation with a cylinder port 94*a* (refer to FIGS. 12 and 14) and the oil guide groove 4 as that of the first embodiment.

On the other hand, as shown in FIGS. 13 and 14, a plurality of cylinder ports 94*a* are opened at specified intervals in an identical circle on a slide surface 95*a* of a cylinder block 95 having axially extended cylinders 94. As shown in FIG. 13, an annular groove 97 is provided outwardly of the cylinder ports 94*a*, 94*a*, . . . on the slide surface 95*a* of the cylinder block 95. The annular groove 97 is communicated with an outer end of an intermittent drain groove 85 formed on the slide surface 81*a* of the valve plate 81. Further, the annular groove 97 is communicated with a drain by way of cut portions 98*a*, 98*b* and 98*c* provided at an interval of 120 degrees on the circumference of the annular groove 97.

According to the fourth embodiment, intermittent drainage is discharged from the intermittent drain groove 85 on the slide surface 81*a* of the valve plate 81 to the drain by way of the annular groove 97 and the cut portions 98*a*, 98*b* and 98*c* on the slide surface 95*a* of the cylinder block 95. Therefore, the energy is gradually attenuated while the intermittent drainage is discharged from the intermittent drain groove 85 to the drain via the annular groove 97, and consequently a reduced noise results.

Furthermore, the annular groove 97 of the cylinder block 95 is originally provided for balancing the pressure between the cylinder block 95 and the valve plate 81. Therefore, the intermittent drain passage 85 is constituted only by the intermittent drain groove 85 of which both ends are closed and which is provided on the slide surface 81*a* of the valve plate 81. Therefore, the intermittent drain groove 85 can be formed easily at low cost.

Furthermore, since the intermittent drain groove 85 extends in the radial direction of the valve plate 81, it can be easily processed.

Although the variable displacement type piston pump has been described as an example of the variable displacement type piston machine in the above embodiments, it is of course acceptable to apply this invention to a variable displacement type piston motor that is another example of the variable displacement type piston machine. In the case of the variable displacement type piston motor, the oil guide groove is provided on the slide surface of the valve plate in a manner that it extends from the suction port to the top dead center. The intermittent drain passage is provided in the vicinity of the oil guide groove.

As is apparent from the above description, according the present invention, there is provided a variable displacement type piston machine including the oil guide groove which extends from the high pressure port to the dead center and is provided on the slide surface between the low pressure port and the high pressure port, wherein the high pressure port and the cylinder port are communicated with each other via the oil guide groove to cause a gradual pressure variation inside the cylinder and the high pressure port, comprising the intermittent drain passage which is opened on the slide surface of the valve plate and directly communicates with neither the high pressure port nor the oil guide groove, wherein, in an initial stage in which the high pressure port and the cylinder port are communicated with each other via the oil guide groove, the intermittent drain passage communicates with none of the high pressure port, the oil guide groove and the cylinder port, and when the cylinder block is further rotated, the intermittent drain passage communicates with the high pressure port via the cylinder port. The intermittent drain passage is closed when a back flow is taking place in the oil guide groove, and the intermittent drain passage is made to communicate with the high pressure port via the cylinder port when the back flow disappears in the oil guide groove, thereby discharging the operating fluid from the high pressure port to the drain. Therefore, the pulsation inside the high pressure port is reduced to allow the noise and vibration to be reduced, so that the operation characteristic of the whole apparatus is improved.

Furthermore, according to the variable displacement type piston machine of the present invention, the intermittent drain passage intermittently communicates with the cylinder port, meaning that the drain flow is not always formed. Therefore, an increased volume efficiency is achieved in comparison with one provided with a passage in which a drain flow is always formed.

According to the variable displacement type piston machine of one embodiment, the intermittent drain passage comprises the first intermittent drain passage part and the second intermittent drain passage part. In the first state, the first intermittent drain passage part communicates with the cylinder port to communicate with the high pressure port via the cylinder port, while the second intermittent drain passage part is not communicated with the cylinder port. In the second state in which the cylinder block has rotated from the first state, both the first intermittent drain passage part and the second intermittent drain passage part communicate with the cylinder port to communicate with the high pressure port via the cylinder port. In the third state in which the cylinder block has rotated from the second state, the second intermittent drain passage part communicates with the cylinder port to communicate with the high pressure port via the cylinder port, while the first intermittent drain passage part is not communicated with the cylinder port. Therefore, the flow rate of drainage is controlled in two steps by the first and second intermittent drain passage parts in accordance with the rate of back flow flowing through the oil guide groove to allow the sum of the rate of back flow and the flow rate of drainage to be approximately constant, so that the pulsation inside the high pressure port can be further reduced.

According to the variable displacement type piston machine of one embodiment, the intermittent drain passage is provided on the slide surface of the valve plate, and one intermittent drain groove is provided which intermittently communicates with the cylinder port according to the rotation of the cylinder block. Further, the cylinder block slides on the slide surface of the valve plate, and the valve plate receives small impact and vibration from the cylinder block. Therefore, the intermittent drain groove scarcely clogs with dirts and foreign matters, and if it is clogged, the dirt or the like can be easily removed.

According to the variable displacement type piston machine of one embodiment, the first intermittent drain passage part and the second intermittent drain passage part are the first intermittent drain groove and the second intermittent drain groove, respectively, which are provided on the slide surface of the valve plate, and the cylinder block slides on the slide surface of the valve plate, whereby the valve plate receives small impact and vibration from the cylinder block. Therefore, the first and second intermittent drain grooves scarcely clog with dirts and foreign matters, and if they are clogged, the dirt or the like is easily removed.

According to the variable displacement type piston machine of one embodiment, the intermittent drain passage is comprised of the intermittent drain groove provided on the slide surface of the valve plate and the through hole that is communicated with the intermittent drain groove and axially penetrates the valve plate to communicate with the drain. Consequently, the cylinder block slides on the intermittent drain groove on the slide surface while vibrating minutely. Therefore, the intermittent drain groove scarcely clogs with dirt or the like, and if it is clogged, the dirt or the like is easily removed. Furthermore, the operating fluid is discharged to the drain via the through hole that axially penetrates the valve plate. Therefore, the direction in which the operating fluid flows is changed at the connection between the intermittent drain groove and the through hole, so that the energy is consumed to allow the noise in discharging the operating fluid to the drain or the like is reduced.

According to the variable displacement type piston machine of one embodiment, the intermittent drain passage is comprised of only the intermittent drain groove that is provided on the slide surface of the valve plate and opened at the peripheral surface of the valve plate. Therefore, the intermittent drain groove scarcely clogs with dirt or the like, and the dirt or the like is easily removed.

According to the variable displacement type piston machine of one embodiment, the intermittent drain passage is comprised of only the through hole that penetrates the valve plate. Therefore, the intermittent drain passage is easily processed.

According to the variable displacement type piston machine of one embodiment, the intermittent drain passage has the plurality of intermittent drain grooves that successively communicate with the cylinder port according as the cylinder block rotates. Therefore, the amount of operating fluid discharged to the drain through the intermittent drain passage can be controlled in a number of steps according to the rate of back flow in the oil guide groove. Therefore, the pulsation, vibration and noise can be further reduced.

According to the variable displacement type piston machine of one embodiment, the plurality of intermittent drain grooves are arranged parallel to one another. Therefore, the intermittent drain passage can be easily processed.

According to the variable displacement type piston machine of one embodiment, the intermittent drain passage is comprised of the intermittent drain through hole that axially penetrates the valve plate and is opened at the slide surface and the back surface and the groove that is provided on the back surface of the valve plate and is communicated with the intermittent drain through hole and the drain. Therefore, the rate of intermittent drainage can be regulated by the groove on the back surface. Therefore, the diameter of the intermittent drain through hole can be increased, so that the possible occurrence of clogging can be prevented.

Furthermore, the groove for regulating the rate of intermittent drainage is located on the back surface of the valve plate and not on the slide surface. Therefore, if the slide surface is worn away, its dimensions do not change. Therefore, according to this embodiment, the rate of intermittent drainage receives no influence of the wearing of the slide surface of the valve plate.

According to the variable displacement type piston machine of one embodiment, the slide surface of the valve plate is a part of a sphere, the back surface of the valve plate is a flat surface, and the slide surface of the cylinder block is a part of a sphere to be fitted to the slide surface of the valve plate. Therefore, it is not required to provide the intermittent drain passage groove on the slide surface of a part of a sphere. Therefore, the intermittent drain passage can be easily processed.

According to the variable displacement type piston machine of one embodiment, the intermittent drain passage is comprised of the intermittent drain groove which is provided on the slide surface of the valve plate and of which both ends are closed, and the intermittent drain groove is always communicated with the annular groove formed on the slide surface of the cylinder block and communicated with the drain. Therefore, the energy is gradually decreased while the intermittent drainage is discharged from the intermittent drain groove through the annular groove to the drain, consequently reducing noise.

Furthermore, the annular groove of the cylinder block is originally provided for balancing the pressure between the cylinder block and the valve plate. Therefore, the intermittent drain passage is provided only by forming the intermittent drain groove of which both ends are closed on the slide surface of the valve plate. Therefore, the intermittent drain passage is formed easily at low cost.

According to the variable displacement type piston machine of one embodiment, the intermittent drain groove extends approximately in the radial direction of the valve plate, and the outer end of the intermittent drain groove is communicated with the annular groove. Therefore, the intermittent drain groove that extends in the radial direction is easily processed.

INDUSTRIAL APPLICABILITY

The variable displacement type piston machine of the present invention is used as a variable displacement type piston pump or a variable displacement type piston motor in construction machines, machine tools, industrial machines and the like.

What is claimed is:

1. A variable displacement type piston machine provided with: a valve plate (1, 11, 53, 71, 81) having a slide surface (1*a*, 71*a*, 81*a*) at which a low pressure port (2) and a high pressure port (3) are opened; a cylinder block (55, 95), in which pistons (57) respectively reciprocate in a plurality of axially provided cylinders (54, 94) and cylinder ports (54*a*, 94*a*) respectively communicated with the cylinders (54, 94) are opened on a slide surface of the cylinder block that slides on the slide surface (1*a*, 11*a*, 71*a*, 81*a*) of the valve plate (1, 11, 53, 71, 81), and which rotates to the valve plate (1, 11, 53, 71, 81); and an oil guide groove (4) which is provided between the low pressure port (2) and the high pressure port (3) on the slide surface (1*a*, 11*a*, 71*a*, 81*a*) of the valve plate (1, 11, 53, 71, 81) and extends from the high pressure port (3) toward a dead center (B), said high pressure port (3) and said cylinder port (54*a*, 94*a*) being communicated with each other via the oil guide groove (4) to cause a gradual pressure variation inside the cylinders (54, 94) and the high pressure port (3), the variable displacement type piston machine comprising an intermittent drain passage (5, 15, 75, 85) which is opened on the slide surface (1*a*, 11*a*, 71*a*, 81*a*) of the valve plate (1, 11, 71, 81) and directly communicates with neither the high pressure port (3) nor the oil guide groove (4), wherein in an initial stage in which the high pressure port (3) and the cylinder port (54*a*, 94*a*) are communicated with each other via the oil guide groove (4), the intermittent drain passage (5, 15, 75, 85) communicates with none of the high pressure port (3), the oil guide groove (4) and the cylinder port (54*a*, 94*a*), and when the cylinder block (55) is further rotated, the intermittent drain passage (5, 15, 75, 85) communicates with the high pressure port (3) via the cylinder port (54*a*, 94*a*).

2. A variable displacement type piston machine as claimed in claim 1, wherein the intermittent drain passage part (15) comprises a first intermittent drain passage part (15*a*) and a second intermittent drain passage part (15*b*), and, in a first state, the first intermittent drain passage part (15*a*) communicates with the cylinder port (54*a*) to communicate with the high pressure port (3) via the cylinder port (54*a*), while the second intermittent drain passage part (15*b*) is not communicated with the cylinder port (54*a*), and, in a second state in which the cylinder block (55) has rotated from the first state, both the first intermittent drain passage part (15*a*) and the second intermittent drain passage part (15*b*) communicate with the cylinder port (54*a*) to communicate with the high pressure port (3) via the cylinder port (54*a*), and, in a third state in which the cylinder block (55) has rotated from the second state, the second intermittent drain passage part (15*b*) communicates with the cylinder port (54*a*) to communicate with the high pressure port (3) via the cylinder port (54*a*), while the first intermittent drain passage part (15*a*) is not communicated with the cylinder port (54*a*).

3. A variable displacement type piston machine as claimed in claim 1, wherein the intermittent drain passage (5) has one intermittent drain groove (5*a*) which is provided on the slide surface (1*a*) of the valve plate (1) and intermittently communicates with the cylinder port (54*a*) according as the cylinder block (55) rotates.

4. A variable displacement type piston machine as claimed in claim 2, wherein the first intermittent drain passage part (15*a*) and the second intermittent drain passage part (15*b*) are respectively a first intermittent drain groove (15*a*) and a second intermittent drain groove (15*b*) which are provided on the slide surface (11*a*) of the valve plate (11).

5. A variable displacement type piston machine as claimed in claim 1, wherein the intermittent drain passage (5) is comprised of an intermittent drain groove (5*a*) provided on the slide surface (1*a*) of the valve plate (1) and a through hole (5*b*) which is communicated with the intermittent drain groove (5*a*) and axially penetrates the valve plate (1) to communicate with a drain (60).

6. A variable displacement type piston machine as claimed in claim 1, wherein the intermittent drain passage (15) is comprised of only an intermittent drain groove (15*a*, 15*b*, 15*c*) which is provided on the slide surface (1*a*) of the valve plate (11) and opened at a peripheral surface of the valve plate (11).

7. A variable displacement type piston machine as claimed in claim 1, wherein the intermittent drain passage is comprised of only a through hole which penetrates the valve plate.

8. A variable displacement type piston machine as claimed in claim 1, wherein the intermittent drain passage (15) has a plurality of intermittent drain grooves (15*a*, 15*b*) which successively communicate with the cylinder ports (54*a*) according as the cylinder block (55) rotates.

9. A variable displacement type piston machine as claimed in claim 8, wherein the plurality of intermittent drain grooves (15*a*, 15*b*) are parallel to one another.

10. A variable displacement type piston machine as claimed in claim 1, wherein the intermittent drain passage (75) is comprised of: an intermittent drain through hole (75*a*) which axially penetrates the valve plate (71) and is opened at the slide surface (71*a*) and a back surface (71*b*) of the valve plate (71); and a groove (75*b*) which is provided on the back surface 71*a* of the valve plate (71) and is communicated with the intermittent drain through hole (75*a*) and a drain.

11. A variable displacement type piston machine as claimed in claim 10, wherein the slide surface (71*a*) of the valve plate (71) is a part of a sphere, the back surface (71*b*) of the valve plate (71) is a flat surface, and the slide surface of the cylinder block is a part of a sphere that fits to the slide surface (71*a*) of the valve plate (71).

12. A variable displacement type piston machine as claimed in claim 1, wherein the intermittent drain groove (85) is an intermittent drain groove (85) which is provided on the slide surface of the valve plate (81) and of which both ends are closed, and said intermittent drain groove (85) is always communicated with an annular groove (97) which is formed on the slide surface (96) of the cylinder block (95) and communicated with a drain.

13. A variable displacement type piston machine as claimed in claim 12, wherein the intermittent drain groove (85) extends approximately in a radial direction of the valve plate (81), and an outer end of the intermittent drain groove (85) is communicated with the annular groove (97).

* * * * *

UNITED STATES PATENT AND TRADEMARK OFFICE

CERTIFICATE OF CORRECTION

PATENT NO. : 5,807,080

DATED : Sep. 15, 1998

INVENTOR(S) : Ochiai et al.

It is certified that error appears in the above-identified patent and that said Letters Patent is hereby corrected as shown below:

TITLE PAGE:

In category [86], please amend the § 371 and § 102(e) dates as follows:

-- § 371 Date: October 4, 1996 --

-- § 102(e) Date: October 4, 1996 --

Signed and Sealed this

Twenty-first Day of December, 1999

*Attest:*

Q. TODD DICKINSON

*Attesting Officer*

*Acting Commissioner of Patents and Trademarks*